United States Patent [19]

Kline et al.

[11] 4,304,041

[45] Dec. 8, 1981

[54] AUTOMATIC TOOL CHANGER FOR FORGING MACHINES

[75] Inventors: Gaylen O. Kline; Harry A. Dom, both of Tiffin, Ohio

[73] Assignee: The National Machinery Company, Tiffin, Ohio

[21] Appl. No.: 109,474

[22] Filed: Jan. 4, 1980

[51] Int. Cl.[3] ..... B23Q 3/155; B23D 35/00

[52] U.S. Cl. ..... 29/568; 72/404; 72/446; 83/549

[58] Field of Search ..... 29/568; 72/404, 446, 72/447, 448, 455; 414/744; 83/549, 563

[56] References Cited

U.S. PATENT DOCUMENTS

| | | | |
|---|---|---|---|
| 3,559,446 | 2/1971 | Dom | 72/337 |
| 3,727,442 | 4/1973 | Ridgway | 72/446 |
| 3,834,218 | 9/1974 | Kralowetz | 72/446 |
| 3,921,887 | 11/1975 | Maehara | 72/446 |
| 4,055,095 | 10/1977 | Gramespacher | 29/568 |
| 4,072,236 | 2/1978 | Nomura | 414/744 |
| 4,088,000 | 5/1978 | Tomioka | 72/446 |
| 4,110,897 | 9/1978 | Hipwell | 29/568 |

FOREIGN PATENT DOCUMENTS

| | | |
|---|---|---|
| 2700461 | 7/1978 | Fed. Rep. of Germany . |
| 2738537 | 3/1979 | Fed. Rep. of Germany . |
| 2740042 | 3/1979 | Fed. Rep. of Germany . |
| 2740616 | 3/1979 | Fed. Rep. of Germany . |
| 2740617 | 3/1979 | Fed. Rep. of Germany . |

*Primary Examiner*—Gene P. Crosby

*Attorney, Agent, or Firm*—Pearne, Gordon, Sessions, McCoy & Granger

[57] ABSTRACT

A fully automated tool changer system for multi-station forging machines is disclosed. This system provides a tool and die supporting head providing spaced support rails on which the tools or dies are supported during the transfer between the machine and the tooling rack. Such head is operable to properly position tools and dies which have different diameters for insertion into the cylindrical cavities in which they are mounted within the machine. A second tooling head is rotated to an operative position when the elements of the shear are to be changed. The tool heads are directly supported on the machine frame or the tool rack so that the loads of installing and removing the tooling are directly transmitted to stationery supports and need not be absorbed by the power transfer system. Further, the supports are arranged so that a high degree of positional accuracy is provided during the tool changing operations. Powered clamping means are provided to releasably lock the tooling in its installed position and is structured to assure that adequate locking is provided without jamming. A flushing system is provided to insure that debris does not cause difficulty during the tool changing operations.

24 Claims, 15 Drawing Figures

AUTOMATIC TOOL CHANGER FOR FORGING MACHINES

BACKGROUND OF THE INVENTION

This invention relates generally to automatic tool changers, and more particularly to a novel and improved combined tool changer and forging machines in which the forging machine includes one or more dies located on the machine frame and associated tools located in a reciprocating slide.

Prior Art

Generally in the past, it has been necessary to manually change the tooling and forging machines. Such changes are required when a tool is worn or broken, or can involve a complete change of all of the tooling when the part being manufactured is changed. Considerable production time loss and cost can be involved in such change, particularly when all of the tooling must be changed.

U.S. Pat. No. 3,559,446 (assigned to the assignee of this invention) discloses a forging machine in which power-operated means are provided to releasably clamp the tooling and in which the tooling is arranged for ease of tool changing. However, such machine does not provide for the full automation of the changing of the tools themselves.

SUMMARY OF THE INVENTION

In accordance with the present invention, a novel and improved forging machine is provided in which the changing of all the tools can be performed automatically. In the illustrated embodiment, the machine is provided with a shear for cutting workpieces from elongated lengths of stock. Such shear includes a stationary quill and a reciprocating cutter blade both of which are automatically changed. Further, the machine is progressive former providing a plurality of work stations, each of which includes a die on the die breast portion of the machine frame and a tool on the slide which cooperate to progressively form workpieces. Here again, all of the tools and dies can be automatically changed.

In each instance, the tools and dies are provided with cylindrical bodies which are mounted with a close fit in associated cylindrical cavities formed in the die breast portion of the frame and the slide.

Replacement tools are provided in a storage rack positioned to one side of the machine. Normally, when an entire tooling change is contemplated, an entire set of replacement tooling is positioned within the rack while the machine is operating so that when a tool change is required, the replacement tooling is ready for automatic installation in the machine.

The illustrated tool changer mechanism includes a power transfer mechanism which is programmed with predetermined movements between the storage rack and the machine. Such power transfer is often referred to as an industrial robot and the particular transfer incorporated in the illustrated embodiment is commercially available.

Mounted on the transfer is a tool handling head assembly which is the apparatus which constitutes an important aspect of this invention. Such head is constructed to be precisely positioned at the storage rack and at the machine to remove the installed tooling and to install the replacement tooling. The precise positioning of the head is accomplished by providing locating pins and support surfaces on the rack and on the machine, which are engaged by mating parts on the head so that the head is precisely positioned and is fully supported on either the rack or the machine during the tool changing operation. The head is arranged so that substantially all of its tool removal and installation functions are performed while the head is supported and positioned in such manner. Therefore, the power transfer does not need to precisely position the head, nor does it have to absorb the forces produced during the tooling insertion and removal. Consequently, the positional accuracy requirement and the load supporting capacity of the transfer per se are not difficult to achieve.

It is thus one important aspect of this invention to provide a forging machine with an automatic tool changer in which the transfer system does not have to operate with the full positional accuracy required, nor does it have to withstand the loads encountered during insertion and removal of the tooling.

There are a number of other aspects to this invention. In accordance with an additional important aspect of the invention, the tools and dies which are provided with relatively heavy cylindrical bodies are supported by a support platform as they are inserted and removed from the associated cavities, and also as they are transferred between the machine and the storage rack. This eliminates the need for end-gripping means for gripping and cantilever supporting such tooling. With the illustrated support platform, eccentric loading is virtually eliminated. Further, the position of the support platform can be automatically changed to accommodate tooling of different diameters.

In the illustrated embodiment, the tool handling head assembly is pivotally mounted on the power transfer and is provided with two separate heads. One head having the tool support platform is utilized to remove and install all of the tools and dies at the work stations. The other tool handling head is rotated into an operative position and, in such position, operates to remove and relace the shear components of the tooling.

In accordance with still further aspects of this invention, novel and improved powered clamping means are provided to releasably lock the tooling in its installed position. Such clamping means are structured to ensure that adequate locking is provided without jamming, which can cause problems when the tooling is released for tool changing. Further novel and improved powered means are provided to partially eject the dies from the frame of the machine so that they can be subsequently handled by the tool changing system.

In accordance with still another aspect of this invention, means are provided to flush away any debris which might otherwise cause misalignment of the tool changing head and might otherwise cause difficulties during the insertion of the tooling in the tool cavities. In the illustrated embodiment, the support structure for the head is provided with ports through which coolant liquid or the like is pumped to flush off the support surfaces on the machine. This ensures that no particles will be present to cause improper positioning of the head. Further, a cavity flushing system is provided to clean the tool cavities before the replacement tools are installed.

These and other aspects of this invention are more fully described in the following description of the preferred embodiment of this invention.

DETAILED DESCRIPTION OF THE DRAWINGS

Figure 1:
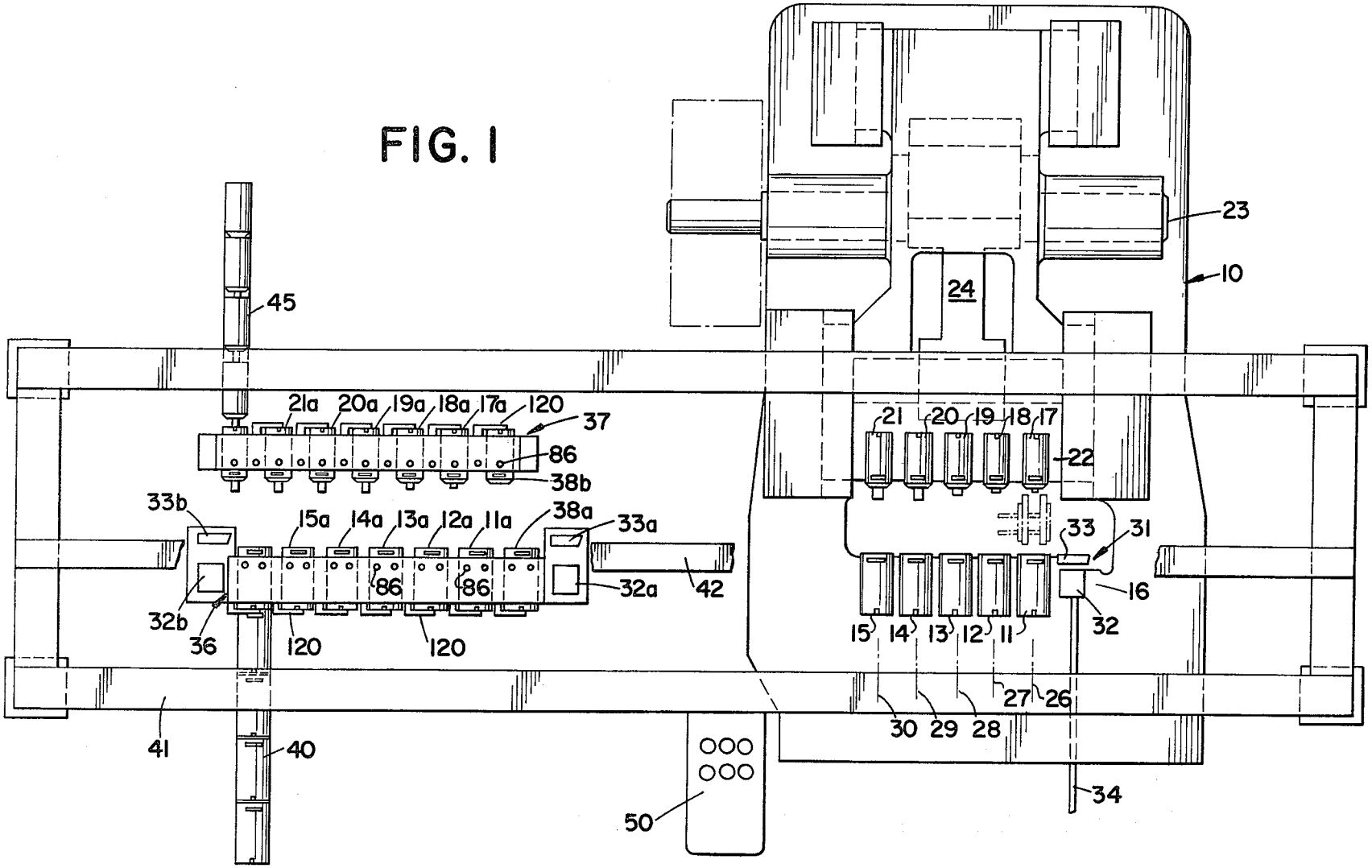
FIG. 1 is a schematic plan view of a progressive former type forging machine in combination with an automatic tool changer in accordance with the present invention.
Figure 2:
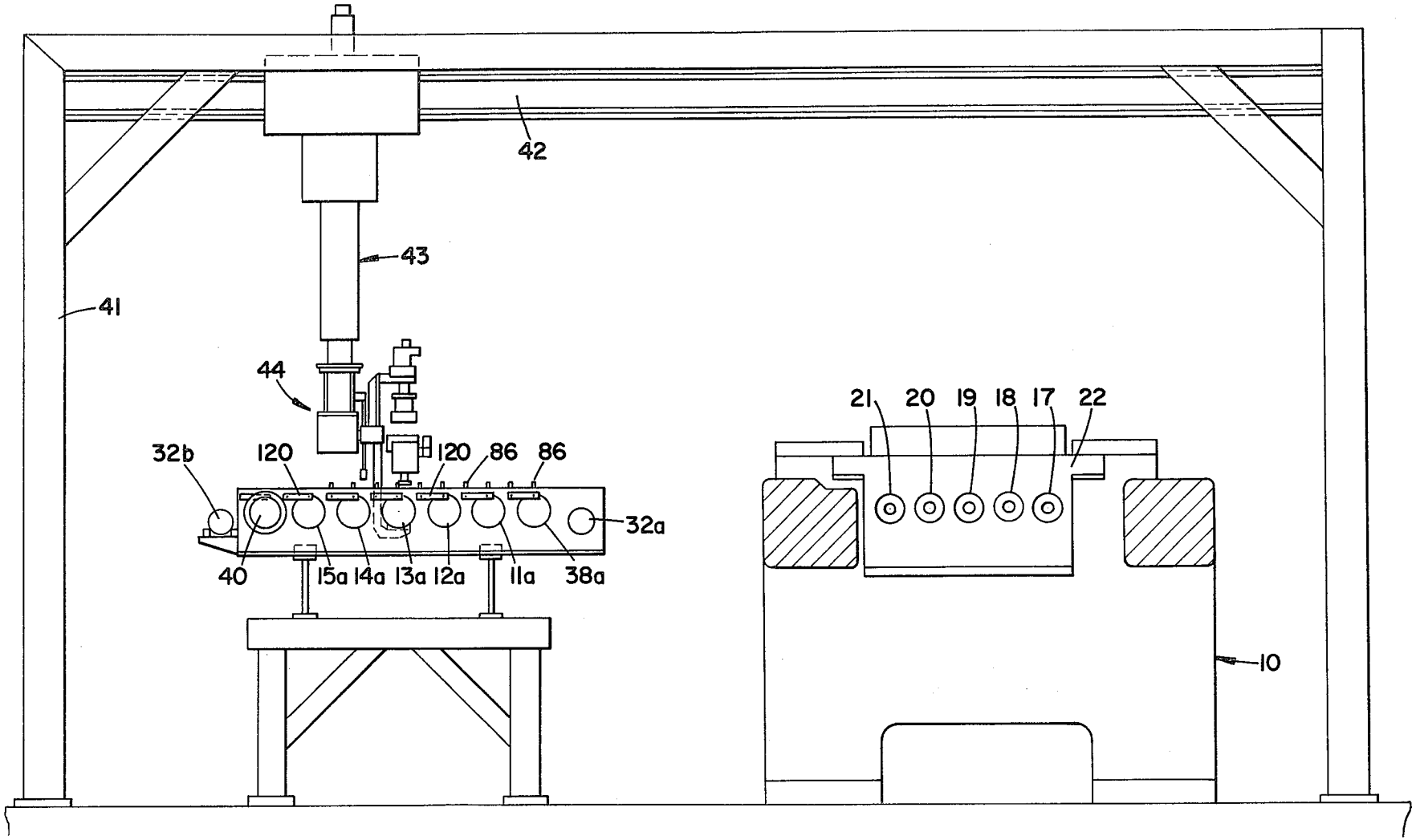
FIG. 2 is a vertical section substantially through the center of the work area of the machine, illustrating the general arrangement of the tools in the machine and the storage rack in which replacement tooling is provided, along with the side elevation of the tool transfer mechanism.

FIGS. 1 and 2 illustrate the overall arrangement of a forging machine with a tool changing system in accordance with the present invention. The system includes a forging machine schematically illustrated at 10. The illustrated machine is commonly referred to as a "progressive former" in that blanks cut from wire or rod stock are progressively positioned at each of a plurality of work stations in which they are progressively formed to the desired shape. Such machine may, for example, be a cold former, a hot former, a header, or any other conventional type of forging machine. Such machine includes a plurality of dies 11 through 15, which are mounted in the die breast portion of the machine frame 16, and associated tools 17 through 21, which are mounted in the reciprocating slide 22 of the machine. Usually the slide is driven by a crank 23 and pitman 24 for reciprocating movement toward and away from the dies, which cooperate in the illustrated machine to provide five work stations 26 through 30 along the indicated centerlines.

Stock in the form of rod or wire is fed into the machine to a shear station 31, where a shear quill 32 and a vertically reciprocating shear blade 33 cooperate to sequentially cut measured lengths of stock 34 from the forward end of the stock. This produces individual workpieces which are sequentially transferred to each of the die stations 26 through 30, where they are progressively formed to the desired shape. The transfer is not illustrated for purposes of simplification, but may be of any suitable type for handling the particular workpieces being produced.

U.S. Pat. No. 2,542,864 schematically illustrates an example of the overall arrangement of one type of progressive forging machine of the general type to which the present invention is applicable. However, it should be understood that the present invention is applicable to other types of machines and that, except insofar as defined in the claims, the specific structure or arrangement of the machine is not critical to the present invention.

Located at a convenient location adjacent the machine are tooling storage racks 36 and 37. The rack 36 is structured with die cavities to receive replacement dies 11*a* through 15*a*, which can be automatically substituted for the dies 11 through 15, respectively in the manner described below. Also mounted in the rack 36 is a replacement quill 32*a* and a replacement shear blade 33*a*, which can be respectively used to replace the quill 32 and shear blade 33. The rack 36 is also provided with a tubular cavity 40 in which the dies 11 through 15 can be positioned when they are removed from the machine 10. In the illustrated embodiment, such tube is arranged to receive the dies in endwise relationship and is sufficiently long to accommodate all of the dies as they are removed from the machine.

Replacement tools 17*a* through 21*a* are supported in a similar manner in the tooling rack 37 and are also transferable by the automatic transfer to replace the respective tools 17 through 21 when such tools are removed by the automatic tool changer, as described below. Here again, the tool rack 37 is provided with an elongated, tubular cavity 45 to receive the tools 17 through 21 as they are removed from the machine during a tool changing operation.

Further, the tooling rack 36 is provided with a location in which a quill 32*b* and a shear blade 33*b* are positioned when it is removed from the machine 10. In addition to the tooling 17*a* through 21*a*, flushing heads 38*a* and 38*b* are positioned in the tooling racks 37 and 36 respectively, which are used to ensure that the tool and die cavities are clean and ready to receive the new tooling during a tool changing operation. Normally, the desired replacement tooling is positioned in the tooling racks 36 and 37, while the machine 10 is operating, so that when a tool change is required, the tooling is ready to be installed when the installed tooling is removed.

A frame 41 extends over the machine and the tooling rack and provides a track system 42 along which a powered transfer 43 (see FIG. 2) is movable between the tooling racks and the machine. Such powered transfer is of the type commonly referred to as an "industrial robot" which is programmed for sequential movements between specific locations and along specific routes. Such powered transfers or mechanical robots are commercially available, and form no part of the present invention except insofar as they are defined in the claims. The illustrated transfer is a Model FB overhead Prab-Versatran mechanical unit, manufactured by Prab Conveyors, Inc. of Kalamazoo, Mich. Such unit is provided with a tool head support 44 on which a tool head 46 is pivotally mounted. The transfer 43 merely functions to move the tool head back and forth in a programmed manner to position the tool head for removing existing tooling and transferring such tooling to the tool storage units and for transferring replacement tooling from the tooling support racks to the machine in the manner discussed in detail below. Such industrial robot is controlled by an electronic control 50.

Figure 3:
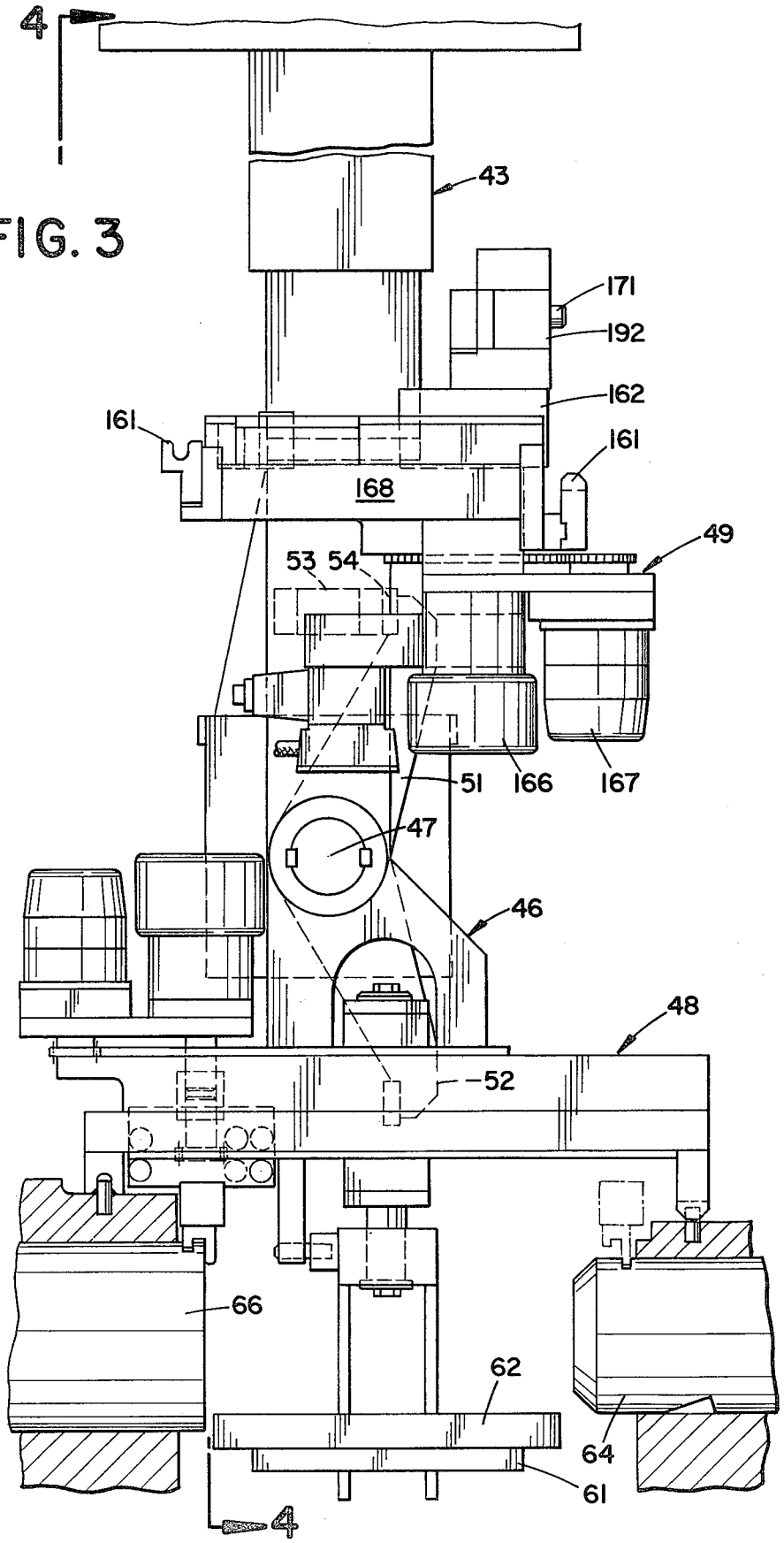
FIG. 3 is an enlarged, fragmentary side elevation of the tool changing head, illustrated in position between the die breast portion of the frame and the slide.
Figure 4:
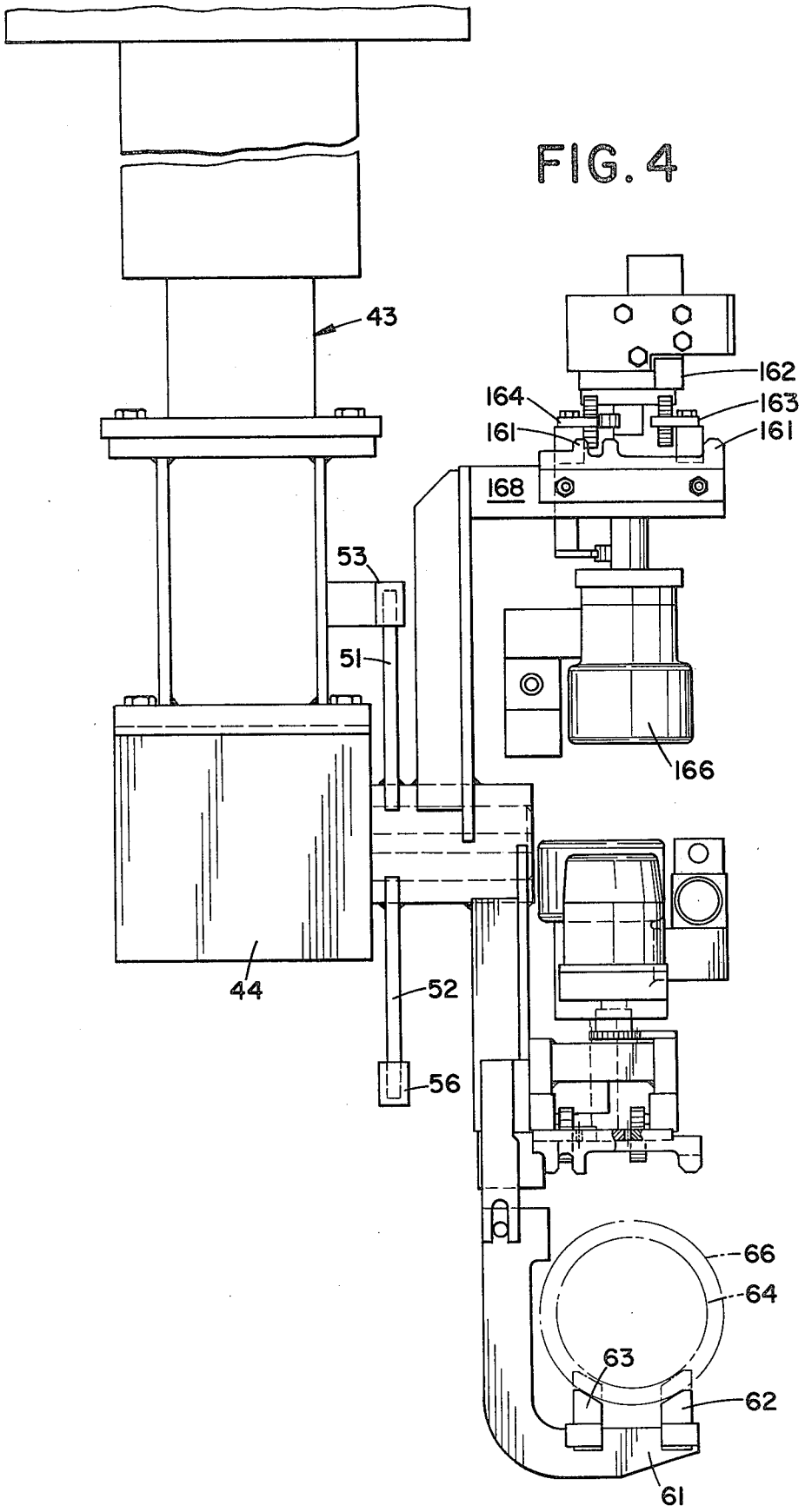
FIG. 4 is a side elevation of the tool changing head illustrated in FIG. 3, taken generally along line 4—4 of FIG. 3.

Referring now to FIGS. 3 and 4, the tooling head 46 is pivotally mounted for oscillating rotation 180 degrees about a pivot axis 47. In one extreme position of its rotation the first tool changing head 48 extends downwardly and a second tool changing head 49 is positioned in an upper position. The first tool changing head 48 is used to transfer the tools 17 through 21 and the dies 11 through 15, and the second tool changing head 49, when rotated to the lower or operative position, is utilized to change the quill 32 and the shear blades 33.

A rotary actuator provided within the head support 44 is operable to locate the tool head 46 through 180 degrees to selectively position the first tool changing head 48 or the second tool changing head 49 in their respective operative positions. Mounted on the head 46 are a pair of stop arms 51 and 52 which are engageable with the ends of a fixed stop member 53 to limit the rotation of the tool head 46 and properly position it in each of its operative postions. Mounted on the arm 51 is a plate 54 which engages one end of the stop whe the first tool changing head 48 is in its operative position. A similar plate 56 mounted on the arm 52 engages the other end of the stop 53 when the second tool changing head 49 is in its operative position.

Referring now to FIGS. 5 through 8, the first tool changing head 48 is operable to change all of the dies 11 through 15 and all of the tools 17 through 21. Such head includes a support platform 61. Mounted on the support platform 61 are a pair of support rails 62 and 63 which are spaced apart and provided with inclined surfaces which cooperate to support cylindrical tool body 64 or a cylindrical die body 66, as the case may be. In the illustrated machine, all of the dies 11 through 15 are mounted within cylindrical die bodies 66 of one diameter and each of the tools 17 through 21 is mounted within cylindrical tool bodies 64 of another diameter. In the illustrated embodiment, the cylindrical tool bodies 64 have a diameter which is less than the diameter of the cylindrical die bodies. The support platform 61 is movable with respect to the tool head between two positions, one of which is in alignment with the tool bodies 64 and the other of which is in alignment with the die bodies 66 in a manner described below.

Figure 5:
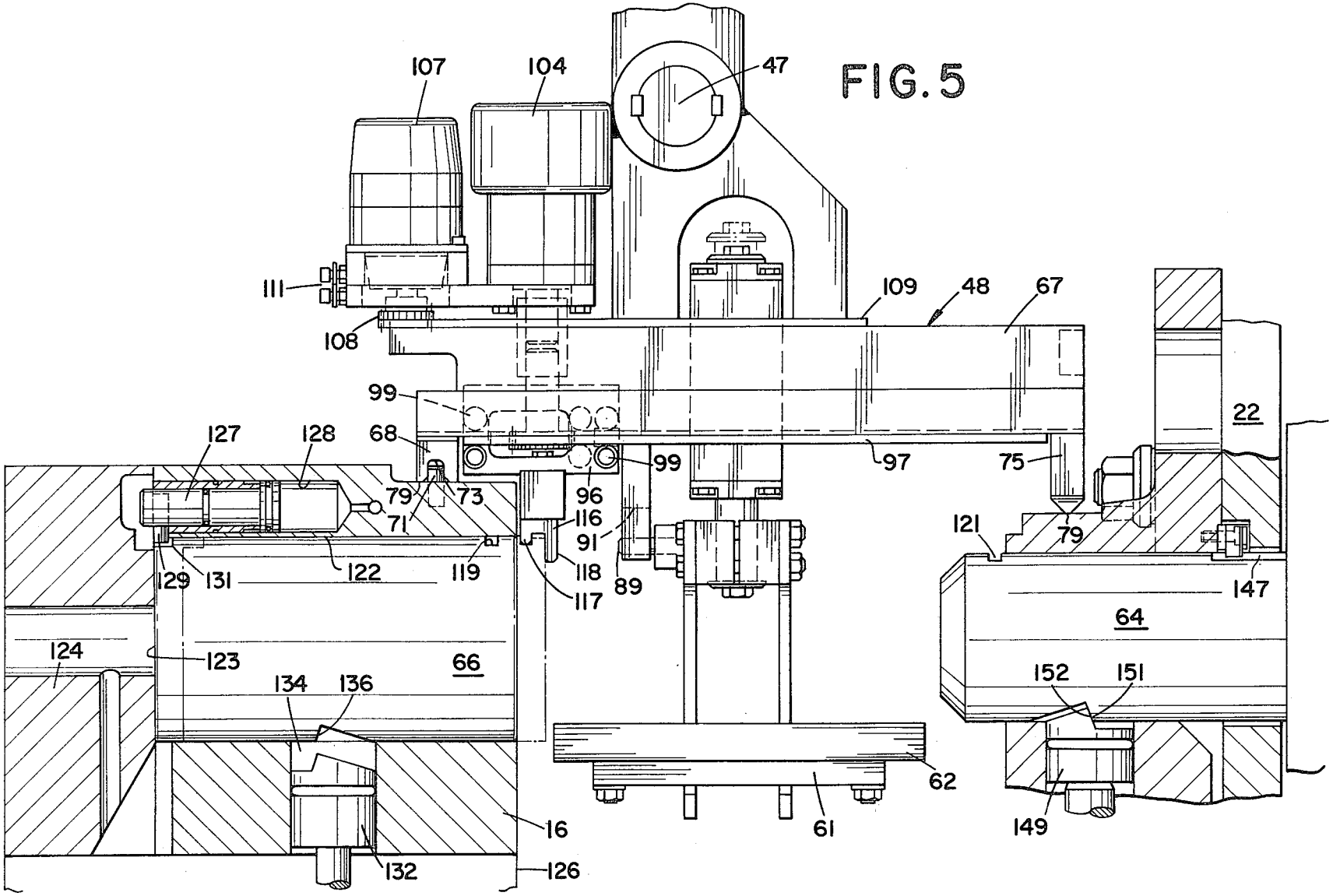
FIG. 5 is an enlarged, fragmentary section, taken generally along the centerline of a work station, illustrating the tool head in position to remove a die from the frame of the machine and illustrating the structure for partially ejecting a die from the die breast to a position where the tool changer can assume control thereof.
Figure 7:
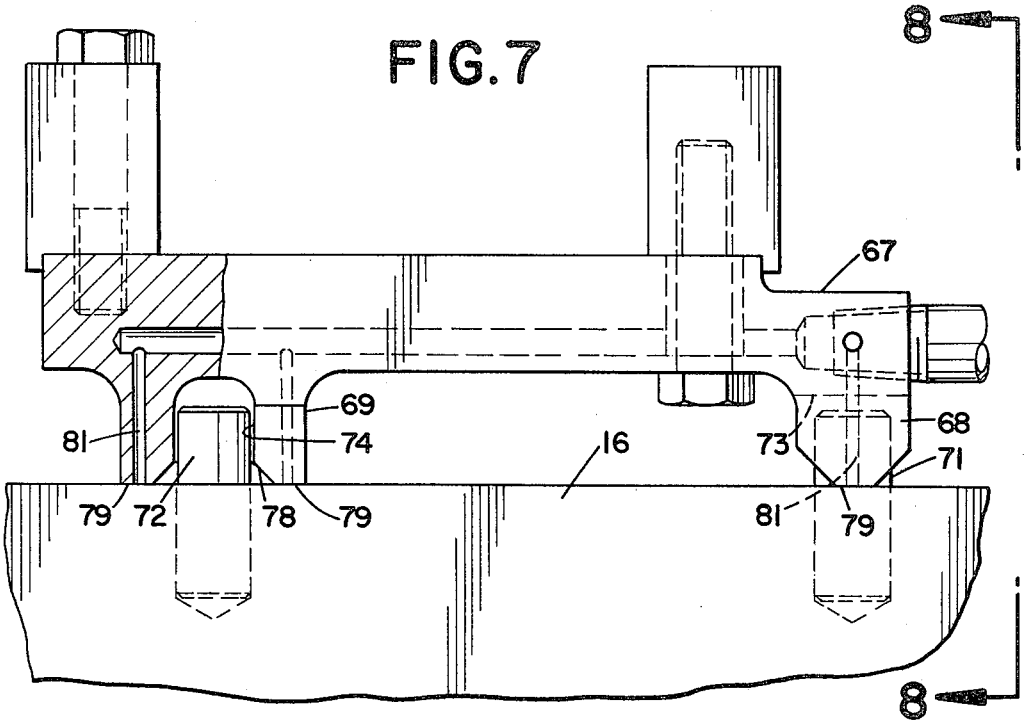
FIG. 7 is an enlarged, fragmentary view of the locating and supporting system provided at one end of the tool changing head for supporting such head on the machine during tool changing operations.
Figure 8:
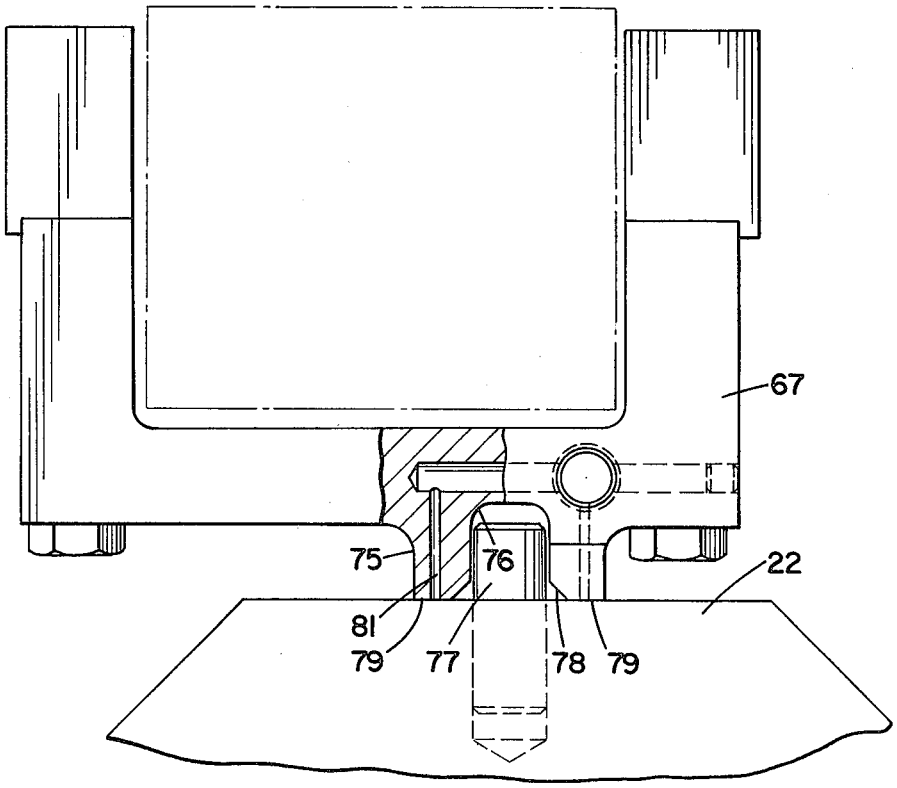
FIG. 8 is another fragmentary view similar to FIG. 7, but illustrating the supporting and locating structure at the other end of the tool changing head.

The accurate position of the first tool head with respect to either the machine 12 or the tool racks 36 and 37 is accomplished with a structure best illustrated in FIGS. 5, 7, and 8. The first tool changer head 48 is provided with a frame 67 which extends between the die breast portion of the frame of the machine 16 and the slide 22, as best illustrated in FIG. 5. Mounted on the left end of the frame 67 are a pair of depending projections 68 and 69, which fit over associated pins 71 and 72, respectively, mounted in the die breast portion of the frame 16 on either side of each of the die stations. The projection 68 provides a lateral slot 73 providing opposed walls which closely fit opposite sides of the pin 71 when the head is supported on the machine. The projection 69 is also provided with a slot 74, but the slot 74 extends in a direction perpendicular to the slot 73 and provides opposed sidewalls which closely fit the opposite sides of the pin 72.

The frame 67, at its opposite end, is provided with a third depending projection 75 which is again provided with a slot 76 providing opposed walls which closely fit over a pin 77 mounted in the slide 22. The slot 76 extends in a direction parallel to the slot 74 and in the direction of the axis of the machine. These three projections 68, 69, and 75 cooperate with their associated pins 71, 72 and 77 to precisely position the tool changing head with respect to the machine during the tool changing operation. The two projections 69 and 75, with their slots which extend parallel to the axis of the machine, precisely position the head laterally of the machine in proper alignment with the associated work station and the projection 68, with its slot, cooperates with the pin 71 to precisely position the head longitudinally with respect to the machine.

During changing of the tools and dies, the slide 22 is positioned at its back dead-center position so the spacing between the slide and the face of the dies is uniformly established. Each of the slots 73, 74, and 76 is chamfered at its lower end at 78 so that as the head is lowered into position by the transfer 43, any misalignment is automatically corrected and the head is cammed to the precise position required for proper tool changing. Further, the vertical location of the head is determined by the engagement of the end faces 79 on the various projections which rest on associated surfaces on the frame 16 and slide 22. To ensure that no debris will be present between the surfaces 79 and the mating surfaces on the machine, each of the legs of the projections is provided with a port 81 through which a liquid coolant is pumped as the head is lowered into position to flush away any debris which could otherwise cause misalignment of the head with respect to the machine.

With this structure, in which the head is positioned accurately by the mating parts of the projections, pins, and supporting surfaces on the machine, it is not necessary to utilize the power transfer 43 to precisely position the head during the tool changing operations. It is merely necessary to provide sufficient positional accuracy in the transfer to move the head to a location in which it will be cammed into the precise required position by the pins. Further, with this structure, in which the head is fully supported on the machine during the tool changing operation, the loads on the head resulting from the insertion and removal of the tooling are directly absorbed into the machine structure and need not be supported by the power transfer. This arrangement, therefore, eliminates any tendency for deflections to be produced in the power transfer during the tool changing operation, which deflections could cause inaccuracy of the tool changing head position.

There are three guide pins provided for each of the work stations 26 through 30 to provide accurate positioning of the first head 48 at each work station for removal or replacement of the associated tools and dies in the manner described below. In the illustrated embodiment, there are two guide pins on the die breast portion of the frame and one guide pin on the slide associated with each work station.

A similar pattern of guide pins 86 is provided on the two tool racks 36 and 37 to accurately position the head for removing the tools and dies from the tooling racks. However, in the illustrated embodiment, the tools and dies on the racks 36 and 37 are not in direct alignment with each other, so different guide pins are used to position the head for picking up the tools than are used for positioning the head for picking up the associated dies.

Figure 6:
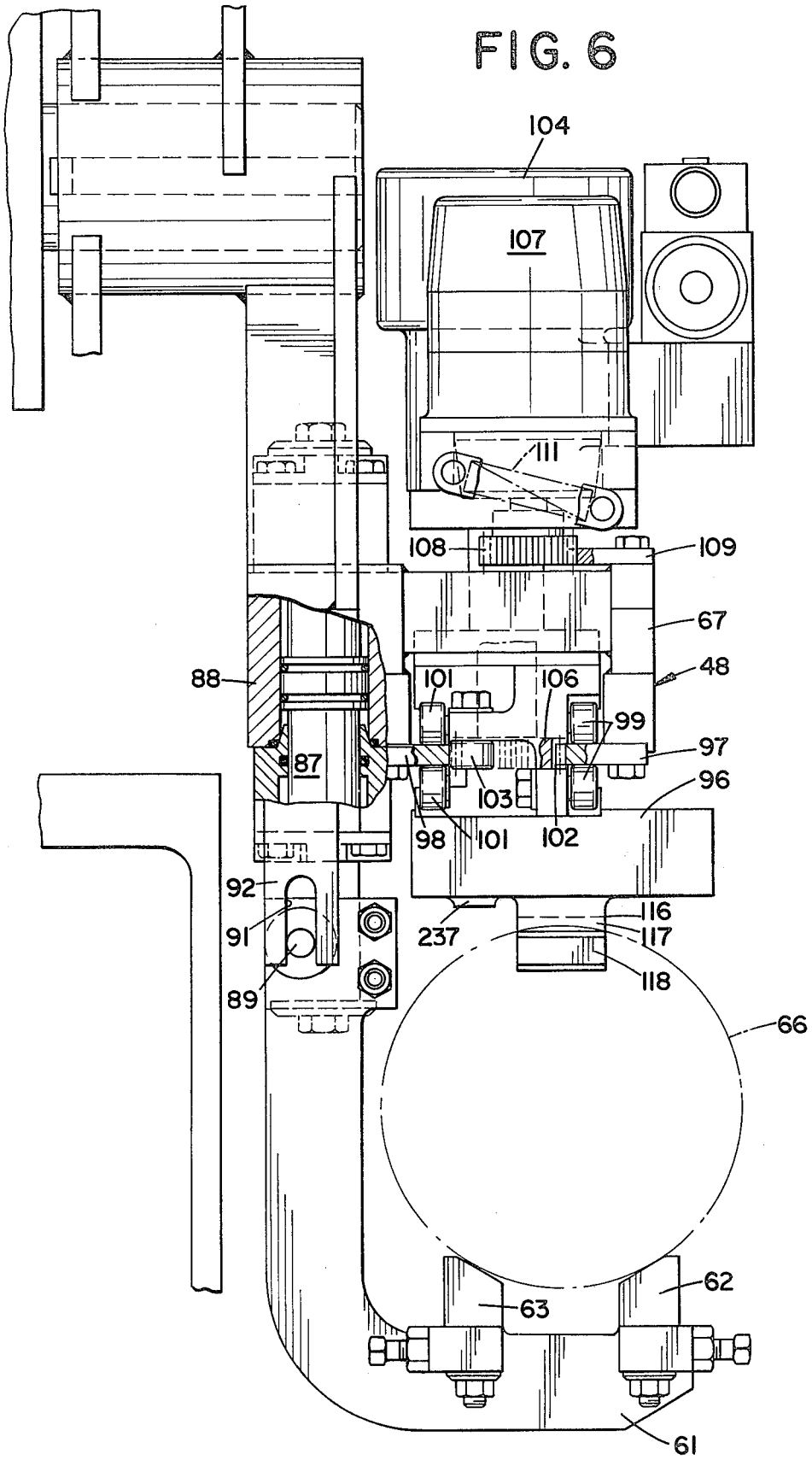
FIG. 6 is a further enlarged, fragmentary end view of the tool changer head, illustrating the structure thereof.

Referring now to FIGS. 5 and 6, the support platform 61 is mounted on the piston 87 of a piston and cylinder actuator 88 so that it can be raised and lowered between its two operative positions. In the raised position, the support rails 62 and 63 are positioned to receive or install the smaller diameter cylindrical tool bodies 64. In the lowered positions, the supports rails 62 and 63 are positioned to receive or install the larger diameter cylindrical die bodies 66. A pin 89 extends laterally from the support platform 61 into a slot 91 on a frame member 92 to ensure proper orientation of the support platform by preventing any rotation of the platform about the axis of the piston 87.

The use of the support platform and the support rails to provide the support for the tools and dies eliminates the need for face gripping means or end gripping means on the tools and dies, and provides an efficient structure for supporting the rather heavy tool and die bodies 64 and 66. The die bodies, for example, may weigh on the order of 100 pounds and, therefore, could provide difficulty if they were cantilever-supported at their ends. This structure further ensures that the transfer is not subjected to significant eccentric loads, and provides the high degree of positional accuracy required to align the tools and dies with their respective cavities for insertion during the installation of the tooling in the machine.

The power for installing and removing the tools and dies is provided through a carriage 96 supported on rails 97 and 98 by opposed rollers 99 and 101, respectively. The rails 97 and 98 are secured to the frame 67 of the head, with the inner edge of the rail 97 being provided with a gear rack 102 and the inner edge of the rail 98 being provided with a flat surface engaged by lateral positioning rolls 103. A drive motor 104, which is preferably a hydraulic motor, is mounted on the carriage 96 and is provided with a pinion gear 106, which engages the rack 102 and operates to drive the carriage back and forth along the rails 97 and 98.

A rotary sensor 107 is also mounted on the carriage 96 and is provided with a pinion gear 108 which meshes with a gear rack 109 to provide an electrical signal indicating the position of the carriage along the frame 67. The signal is supplied to the control system 50 for the transfer so that the operation of the carriage is programmed by the main control system of the transfer 43. The sensor 107 is mounted with a pivot and a spring 111 biases the pinion gear 108 against the rack 109 to eliminate any backlash in the gear so as to ensure accurate position sensing of the carriage.

Depending from the carriage 96 is a tool-engaging element 116 having two spaced, depending fingers 117 and 118. The finger 117 is proportioned to fit into a mating groove 119 in a die body 66, and the finger 118 is proportioned to fit into a groove 121 formed in each of the tool bodies 64. When the finger 117 is positioned within the associated groove 119 of the given die body 66, operation of the drive motor 104 to move the carriage 96 along the tracks 97 and 98 causes axial movement of the die body either into or out of the associated die cavity 122, depending upon the direction of movement of the carriage. Similarly, when the finger 118 engages the groove 121 on a tool body 64, a driving connection is provided to cause axial movement of the tool with the carriage 96.

In the illustrated embodiment, the die body 66, when fully seated in its installed position, provides a rearward face 123 which engages a spacer block 124 in the machine frame. In such position, the face of the die body and die is along the plane 126 and does not project forward beyond the face of the die breast portion of the frame. Consequently, the groove 119 in the die body is spaced back from the face.

Means are provided to partially eject the die body so that it can be engaged by the finger 117. The ejection means include a piston 127 reciprocably mounted within a cylinder bore 128 and provided with a depending projection 129 which is positioned within a slot 131 formed at the rearward end of the die body 66. Such projection provides two functions. First, it maintains the correct orientation of the die body with respect to the frame, and second, it provides a driving connection to partially eject the die body when the piston 127 is operated to move to the right to the phantom line position as viewed in FIG. 5.

Figure 12:
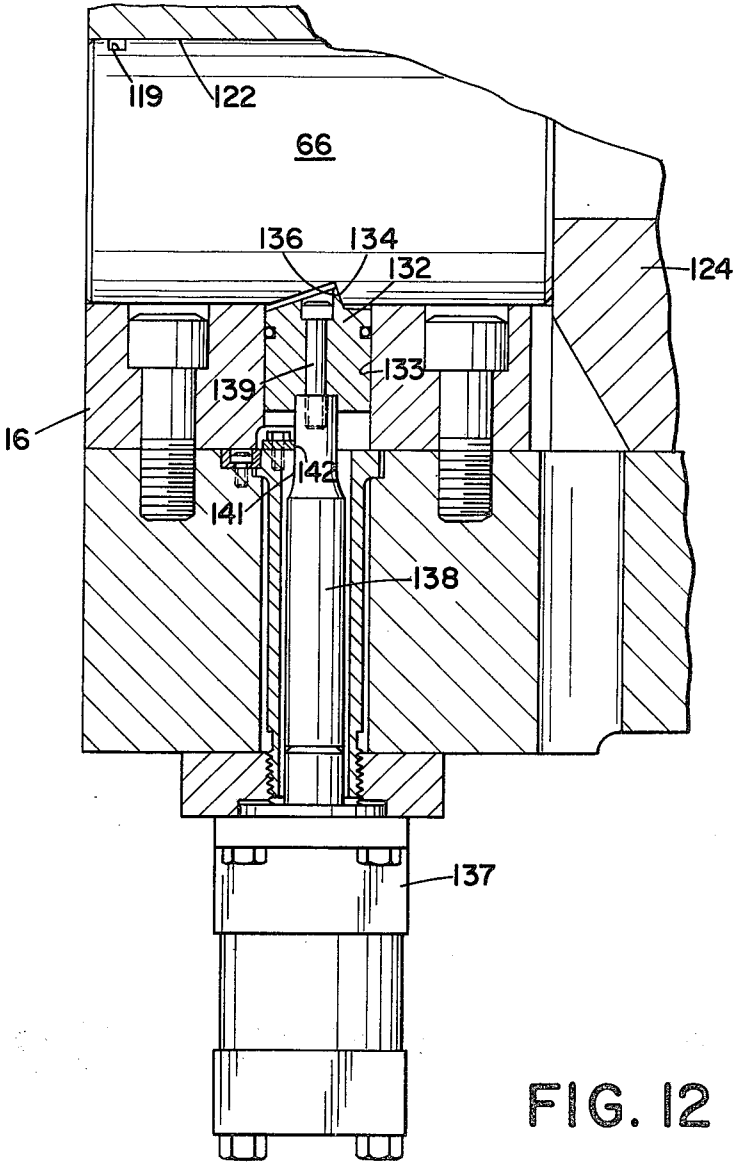
FIG. 12 is a fragmentary cross section of the clamping structure for releasably clamping the dies.

Referring to FIGS. 5 and 12, each of the die bodies 66 is releasably locked in its installed position by a laterally movable wedge 132, illustrated in FIG. 5 in the retracted or released position, and in FIG. 12 in the extended or locking position. The wedge 132 is radially movable in a wedge guide opening 133 formed in the die breast portion of the machine frame. When extended, a ramp surface 134 on the wedge 132 engages a mating ramp surface 136, which cams the die body to its seated position against the spacer plate 124. Preferably, the inclination or angle of the two surfaces 134 and 136 is greater than the locking angle so that the wedge does not become locked in its extended or operative position.

The drive for the wedge 132 is illustrated in FIG. 12. Such drive includes a piston and cylinder actuator 137 having a piston rod extension 138 connected to the wedge by a bolt 139. The upper end of the piston rod extension 138 is formed with a flat 141 engaged by a guide plate 142 to ensure that the piston rod extension 138, and in turn the wedge 132, does not rotate to an incorrect position but is maintained in its proper orientation at all times. When the actuator is extended, the wedge 132 is driven radially inward to lock the associated die body 66 in its installed position. However, when it is required to remove the die body, the actuator 137 is retracted to withdraw the wedge 132 to the position illustrated in FIG. 5, thus releasing the die body so that it can be partially ejected from the die cavity 122 for removal by the tool changing head 48.

Figure 13:
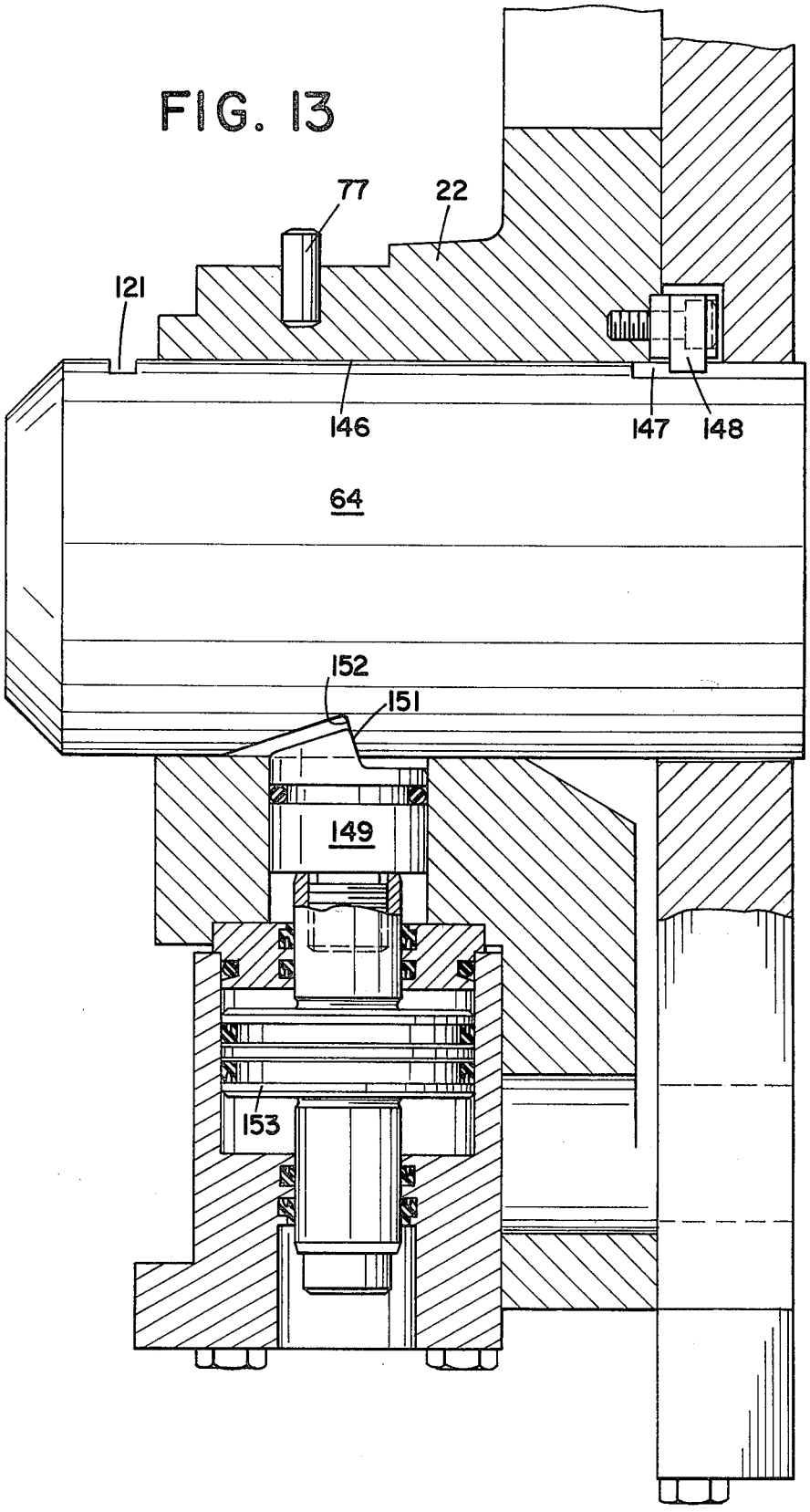
FIG. 13 is a fragmentary side elevation of the clamping mechanism for the tools.

The details of the mounting structure for the tool bodies 64 are best illustrated in FIG. 13. The tool body 64, in its fully installed position, extends forward beyond the end of the tool cavity 146 so the groove 121 is exposed. Consequently, it is not necessary to provide an ejection mechanism to partially eject the tool body from its installed position. It is, however, necessary to ensure that the tool is properly oriented about its central axis within the cavity 146 so that rearward end of the tool body is formed with an axial slot 147 which receives an alignment projection 148 to ensure proper orientation of the tool body.

Here again, a radially movable wedge system is provided to lock the tool in its fully installed position against the face of the slide. Such wedge system includes a wedge 149 having a ramp surface 151 which engages a ramp surface 152 on the tool body 64. Radial movement of the wedge is controlled by a piston 153 which can be extended to drive the wedge radially in for locking the tool body and retracted to withdraw the wedge and release the tool. Here again, the angle of the two ramp surfaces is selected so that a locking taper is not provided. Consequently, all of the actuators for the wedges 132 and 149 are pressurized toward the extended position while the machine is operated to maintain the associated dies and tools in their locked-up condition. Because the wedges and actuators extend perpendicular to the direction of slide travel, the acceleration forces due to slide movement do not affect the locking of the wedge. Retraction of each of the actuators provides selective release of individual tooling or all of the tooling, as the case may be.

The operation of the first tool changing head 48 in changing a given die is as follows. Prior to the movement of the tool changing head to the position of FIG. 5, the associated wedge 132 is retracted to release the die body and the die body is partially ejected by the operation of the piston 127. Such ejection positions the groove 119 to receive the finger 117 when the tool changing head is moved to its pickup position by the power transfer 43. As the power transfer lowers the tool changing head 48 onto the pins, the finger 117 moves into the groove 119. This, of course, requires the proper positioning of the carriage 96 so that the finger is aligned with the groove as it is moved into its operative position on the machine. The motor 104 is then operated to move the carriage 96 to the right, as illustrated in FIG. 5, to move the die body 66 out of the associated cavity 122 and onto the support rails 62 and 63. When the die is fully withdrawn and supported by the rails, the power transfer 43 is operated to move the head to the storage rack and to position the die supported thereby in alignment with the removed die passage 40, where the head is positioned accurately by the associated locating pins 86. The motor 104 is then operated to slide the die body from the support rails 62 and 63 into the die receiving passage 40.

After flushing has been completed in the manner described below, the power transfer 43 is programmed to position the first tool changing head 48 at the appropriate location on the tooling storage racks opposite the tool to be replaced and the tool changing head is lowered onto the appropriate locating pins 86 to align the rails with the selected tool and to position the finger 117 in the slot 119. Pivoted arms 120 on the tooling racks 36 and 37 have ends which are positioned in the slots 131 and 147 when the tooling is placed in the racks to ensure proper orientation of the tooling.

The motor 104 is then operated to move the die out of the support cavity in the tooling rack 136 onto the support rails, where it is supported while the power conveyor moves back to the machine and positions the head adjacent to the appropriate die cavity 122. The slot 119 is flat and extends across the top of the die body in both directions from a central vertical plane. The lower edge of the finger 117 is also flat and mates with the groove. This structure cooperates with the support rails to insure that the proper orientation of the die body, about its axis, is maintained during the entire transfer. When properly positioned on the machine, the drive motor 104 is operated to move to the left, as viewed in FIG. 5, to slide the die body into the cavity 122. Prior to the arrival of the die at the cavity, the pressure is released on the ejection piston 127.

Because the die body must be moved beyond the position in which the finger 117 can engage the groove 119. The movement of the carriage with the finger in the groove 119 can only insert the die body partly into the die cavity. Consequently, when the sensor 107 determines that the carriage 96 is moved to the phantom position illustrated in FIG. 5, the power transfer 43 is operated to raise the head to move the finger 117 out of the groove 119 and the carriage is moved to the right, as viewed in FIG. 5, beyond the end face of the die body. The head is then again lowered to its operative position to position the finger opposite the end of the die body and the carriage is again moved to the left, as viewed in FIG. 5, to complete the insertion of the die body into the cavity 122. When the die is fully installed, the associated wedge 132 is extended to lock the die in its mounted position. The sequence is then repeated as necessary to remove and replace the other dies of the machine as required.

The operation of changing the tools is essentially the same except that it is not necessary to provide partial ejection of the tools, since the grooves 121 are exposed when the tools are fully installed. The tool changing sequence is substantially as follows. The support rails 62 and 63 are raised by the actuator 88 to properly position them for receiving the tools which are, in the illustrated embodiment, mounted in the tool body 64 which has a diameter smaller than the die body 66. The carriage 96 is moved to position the finger 118 so that when the tool changing head is moved by the power transfer 43 to the operative position, the finger 118 projects into the groove 121 of the selected tool. The wedge 149 is withdrawn to release the tool and the carriage is moved to the left, as viewed in FIG. 5, to cause the finger 118 to pull the tool body 64 out of its associated cavity 146 and onto the support rails.

After the sensor 107 establishes that the tool body 64 is in a position in which it is fully supported on the rails 62 and 63 and fully clear of the cavity 146, the power transfer 43 is operated to carry the tool to a position in alignment with the tool receiving passage 45, where the carriage is then operated to slide the tool from the tool head into the passage 45. Subsequently, after flushing as described below, the power transfer 43 is operated to position the head 48 to pick up the proper tool from the tooling rack 37 and to transport such tool to a position in alignment with the proper tool cavity 146 in the slide 22. When properly seated in the operative position for insertion of the tool body 64, the carriage is again operated to insert the tool into the associated tool cavity. In the case of the installation of the tool body, it is possible to move the tool body to its fully installed position as a single operation of the carriage 96 because the groove 121 remains in the exposed position when the tool is fully installed.

Because of the versatility of the machine, it is possible to selectively change one or all of the tools and dies of the machine in an automatic manner. Preferably, the control circuit 50 for the conveyor and the tool changing system is arranged so that the machine operator can, by the mere operation of a single switch or button, automatically change any given tool or die or change an entire set of tools and dies. Consequently, the controls for the various valves for the actuators and motors are interconnected to the overall control system 50 so that the functions which are performed by each component of the system are automatically performed. The industrial robot specified above is provided with a control system 50 which includes a number of channels in addition to the channels required to control the power transfer 43 itself and these channels are connected to control the operation of the various tool changing functioning elements on the heads and on the machine itself.

As mentioned above, the second tool changing head 49 is utilized when it is necessary to change the components of the shear. When the shear components are to be changed, the tool head support 46 is rotated through 180 degrees to move the second tool changing head 49 to the operative position in which it extends downwardly. Here again, the tool changing head 49 is provided with three locating projections 161, which are positioned over associated locating pins mounted on the machine to precisely position the head and to support the head in its operative position. It should be noted that the axial spacing between the locating projections 161 at the ends of the head 49 differs from the spacing provided between the corresponding locating projections on the head 48. This is because the cutter station is located to one side of the slide and both ends of the head rest on the frame position of the machine. Further, the changing of the shear tooling is performed while the shear blade is in its lowered position in alignment with the quill. Therefore, when the changing of the shear components is required, the machine is jogged from the back dead-center position to the proper intermediate position in which the shear blade is in its dwell at its lowered position.

The head 49, like the head 48, is provided with a carriage 162 movable on support tracks 163 and 164 by a drive motor 166. The support and drive of the carriage 162 is essentially the same as the support and drive of the carriage 96, so the structural detail need not be repeated. Further, a sensor 167 is also provided to determine the position of the carriage with respect to the frame 168 and the sensor is mounted to provide zero backlash gear engagement in the same manner as the sensor 107.

Figure 9:
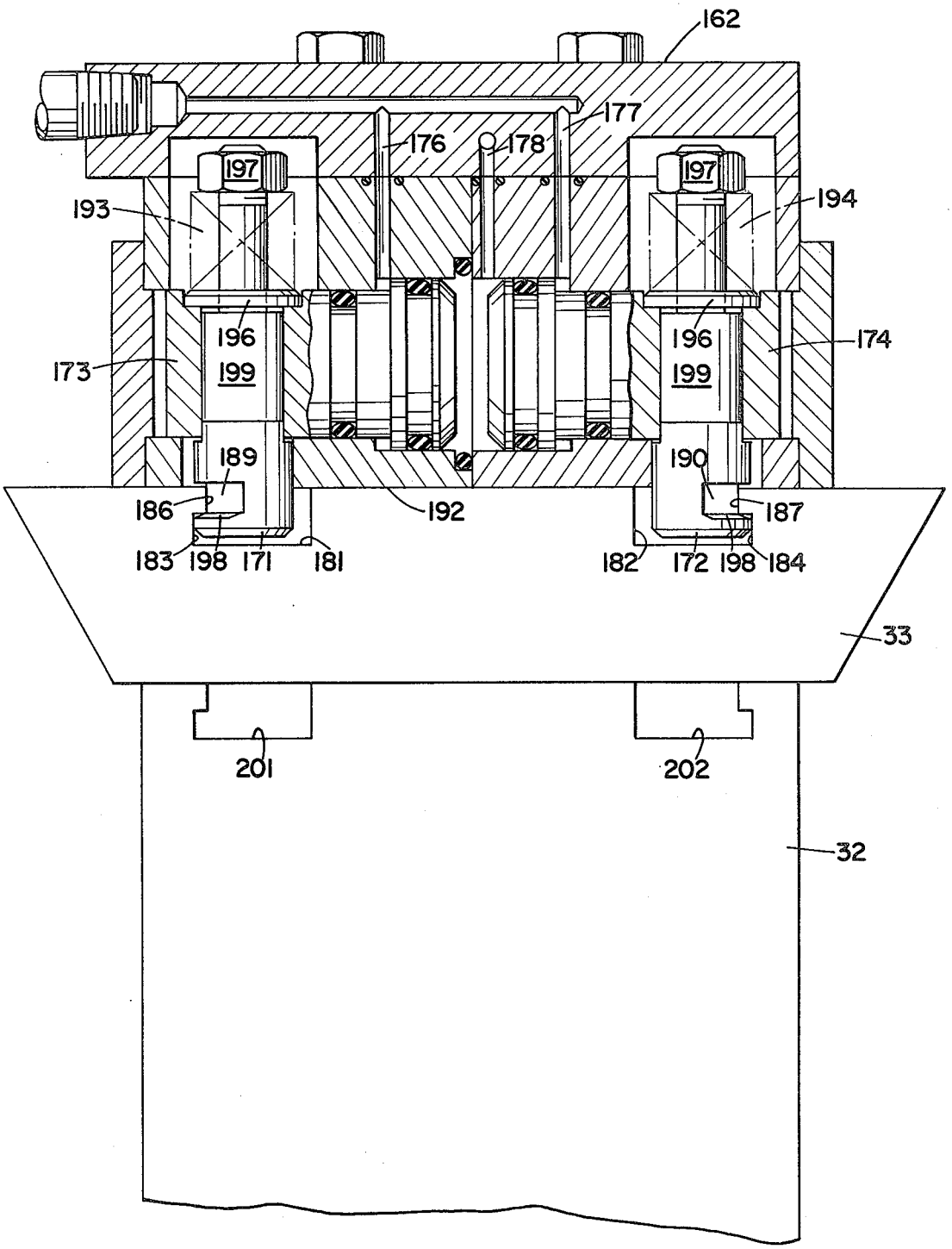
FIG. 9 is an enlarged, fragmentary section illustrating the structure of the mechanism within the tool changing head for gripping and removing the shear blade and shear quill.

The structure of the mechanism for gripping and supporting the cutter blade 33 and the quill 32 is best illustrated in FIG. 9. Such structure includes a pair of grooved pins 171 and 172 which are mounted in laterally movable pistons 173 and 174, respectively. Such pistons are moved toward each other when pressurized through the ports 176 and 177 and are moved apart when pressure is admitted between the ends of the pistons through the port 178. The ends of the pins, when the pistons are retracted to move the pins toward each other, are movable into generally circular openings 181 and 182 in the shear blade 33. Such openings are undercut at their outer ends at 183 and 184 to provide shoulders 186 and 187, respectively. These shoulders project into grooves 189 and 190 when the gripper pins 171 and 172 are positioned in the openings and the pistons 173 and 174 are moved apart by pressure admitted to the port 178.

In order to ensure that the shear blade 33 or quill 32 will be tightly held against the face 192 of the head, the pins 171 and 172 are spring-loaded within the associated pistons in a direction toward the face 192 and are movable against the bias of the springs in a direction away from the face 192. The spring bias is provided by springs 193 and 194, which extend between thrust plates 196 and associated nuts 197. Further, the grooves 189 and 190 are formed with chamfered ends at 198 so that as the pins are moved apart by their associated pistons, the engagement with the associated shoulders 186 and 187 will cam the pins axially against the action of the associated springs. This structure ensures that the gripped part, for example, the shear blade, will be tightly held against the face 192. The stem portions 199 of the two pins 171 and 172 are non-circular and fit into mating openings in the respective pistons to ensure that the pins do not rotate about their axes and are positioned with their respective grooves facing apart.

When the second tool changing head 49 is used to remove a shear blade 33, it is positioned in the operative position with the carriage 162 positioned axially from the blade. After the carriage is positioned in its operative position, the carriage 162 is moved axially while the pistons 173 and 174 are retracted, until the respective pins are positioned within the openings 181 and 182. The pistons are then moved apart to cause the pins to grip the blade 33. The blade is unclamped to then allow its removal. However, in the instance of the blade 33, removal and insertion are accomplished by vertical movement so that the gripped blade is lifted out of its installed position by raising the head with the power transfer 43. Such removal of the blade does not result in excessive loading of the power conveyor, since the blade is relatively small and much lighter than the tools and dies.

The shear blade is releasably clamped in its installed position by hydraulically actuated wedges. The structure for releasably clamping the shear blade 33 and the shear blade holder is not illustrated in the drawings, but reference may be made to U.S. Pat. No. 3,559,446, incorporated herein by reference, which illustrates a shear blade clamping system for releasably locking the shear blade in its installed position. The transfer then delivers the removed shear blade to the position **33*b* illustrated in FIG. 1. If the quill 32 must also be replaced, it is removed prior to the installation of the replacement shear blade so that access is provided for its removal and replacement. The shear quill 32 is provided with openings 201 and 202 similar to the openings 181 and 182 which receive the pins 171 and 172 for gripping the quill 32. In the instance of the quill, however, its removal is axial from its cavity, so after gripping the quill against the end face 192, the carriage 162 is moved by the drive motor 166** to withdraw the quill from its cavity in the frame of the machine. A powered system for releasably clamping the quill is provided. Here again, the weight of the quill is small compared to the weight of the tools and dies, so difficulty is not encountered by supporting the quill from its end rather than on support rails of the type provided in the first tool changing head.

After the quill is removed, it is transferred to the position **32*b*, where it is deposited, and the machine operates to pick up the replacement quill 32*a* and to install such quill automatically. After the installation of the replacement quill, the transfer returns the second head to pick up the replacement shear blade 33a** and to transfer such blade to the machine, where it is installed by vertical downward movement. Because the positioning accuracy of the head through the use of the locating projections and pins is not utilized during the installation of the shear blade, the shear blade is formed with guide chamfers at its lower end to ensure proper entry of the blade into its supporting structure.

Figure 10:
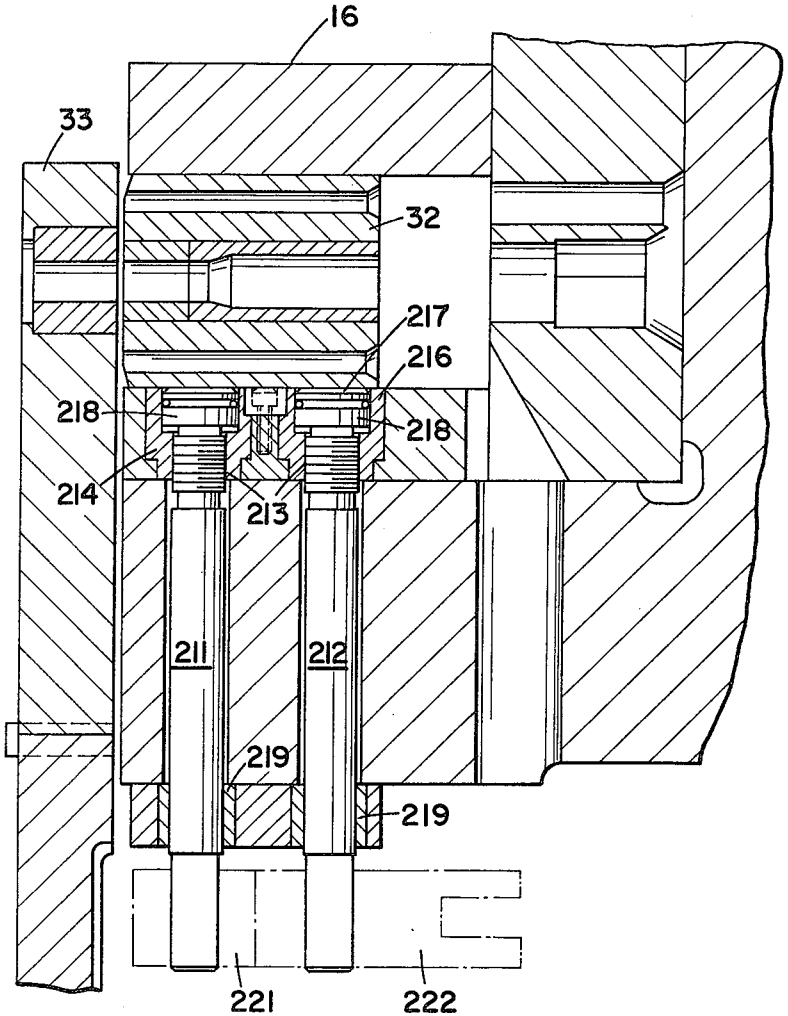
FIG. 10 is a fragmentary section through the shear station, illustrating the structure utilized to clamp the shear quill in its installed position.
Figure 11:
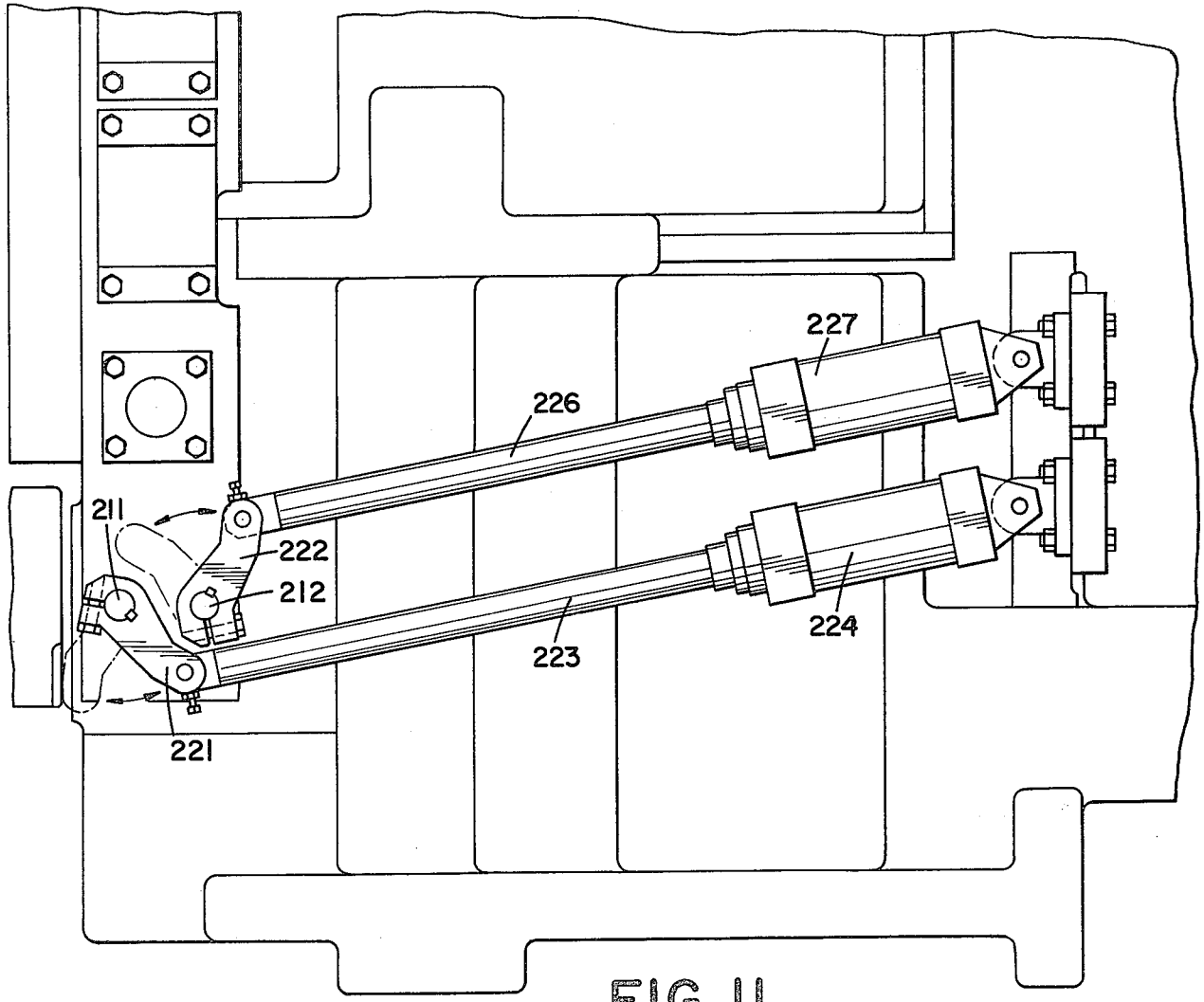
FIG. 11 is a vertical, fragmentary view illustrating the actuation system for operating the quill clamps of FIG. 10.

The clamping mechanism for releasably clamping the quill is best illustrated in FIGS. 10 and 11. Such mechanism includes a pair of screw jacks 211 and 212, which are threaded at 213 into a pair of bushings 214 and 216, respectively. The upper end of each of the screw jacks engages an associated pressure plate 217 and 218 positioned within the counterbores of the associated bushings and thereagainst the underside of the quill to clamp the quill 32 in its installed position when the associated screw jacks are threaded in an upward direction. Rotation of the screw jacks in the opposite direction lowers the screw jacks and releases them for quill removal and replacement. The lower ends of the two screw jacks 211 and 212 extend through bearings 219 and are connected to crank arms 221 and 222, respectively. The arm 221 is pivotally connected to a piston 223 of an actuator 224 and the arm 222 is connected to the piston 226 of an actuator 227, illustrated in FIG. 11. Because of space limitations, the threads 213 on the screw jack 211 are formed with one hand and the threads 213 on the screw jack 212 are formed with the opposite hand so that opposite directions of rotation of each of the levers 221 and 222 from their full line position to the phantom line position causes corresponding downward travel of the respective screw jack and extension of the actuators, causing rotation in the opposite directions of the screw jacks causes release of the clamping action. Further, the thread is sized so that full clamping and release can be accomplished within 60 degrees of rotation of the two screw jacks.

Figure 14:
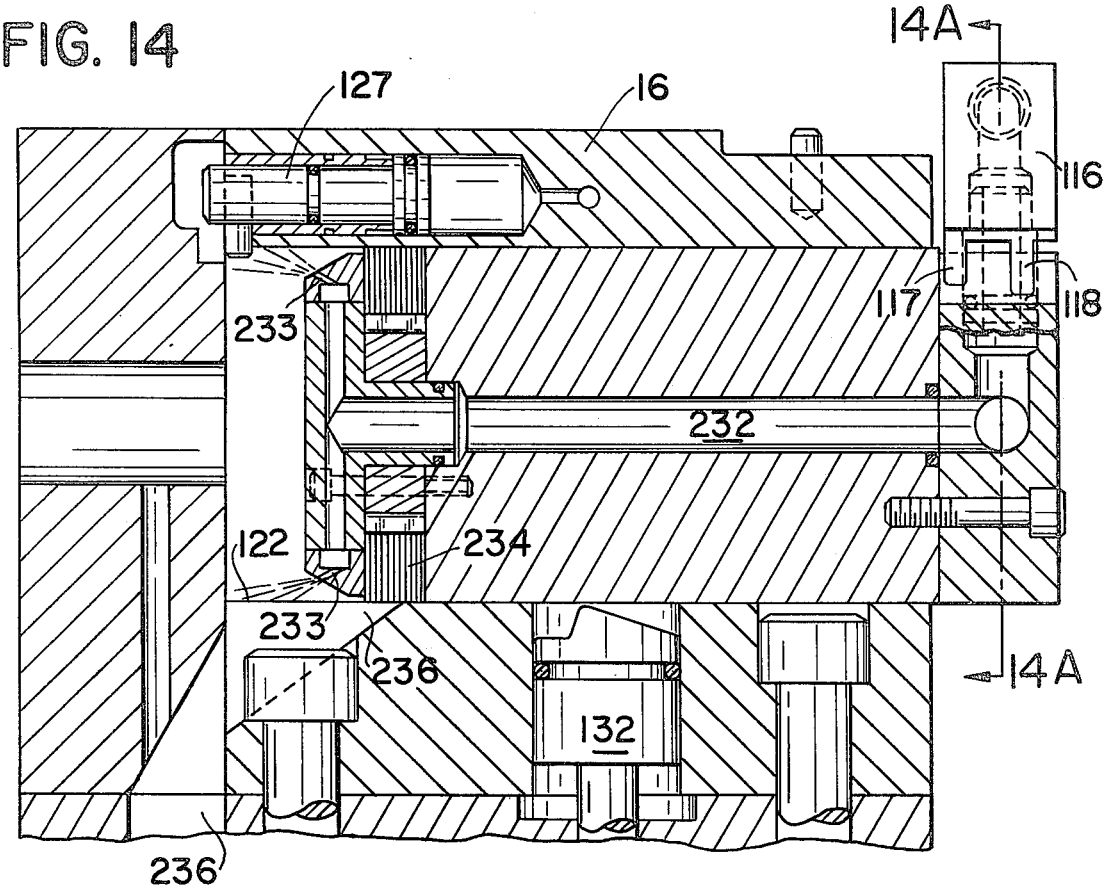
FIG. 14 is a side elevation, partially in section, of a cleaning head operable to flush debris from the die cavities of the machine.

FIG. 14 illustrates a cavity flushing device for cleaning the die cavities to ensure that debris will not be present within the cavity to prevent proper installation of the replacement tooling. The flushing head 38a is provided with a cylindrical body of essentially the same diameter as the die body 66 and is picked up by the power transfer 43 from the tooling rack in essentially the same manner as the die bodies, and is transported by the support rails 62 and 63 to a position in front of associated die cavity 122, which must be cleaned. The carriage is then operated to insert the cleaning head into the cavity while coolant liquid is pumped along a central passage 232 to nozzles 233 from which the coolant is sprayed against the walls of the die cavity 122 as the flushing head is inserted and withdrawn therefrom. Preferably, the flushing head is also provided with a brush 234 to loosen the more stubborn particles which may be present. In order for the coolant to drain from the cavity, the inner end is formed with a drain passage 236.

Figure 14A:
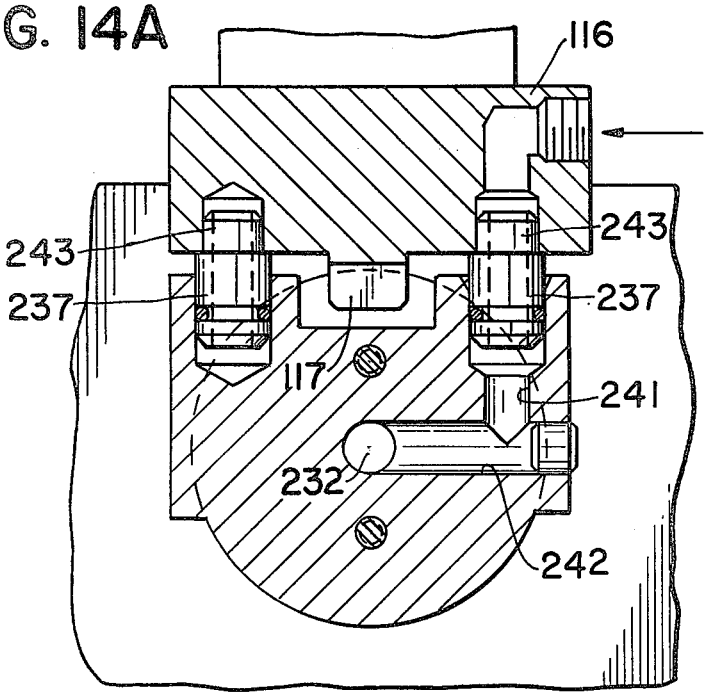
FIG. 14*a* is a fragmentary view taken along line 14*a*—14*a* of FIG. 14 illustrating the supply system for the flushing liquid.

The coolant for flushing out loose particles is preferably introduced to the flushing head through a projection 237 provided on the puller 116 to one side of the fingers 117 and 118, as best illustrated in FIG. 14A. Such projection is provided with an O-ring seal 235 which is moved into the passage 241. The passage 241 is connected to the central passage 232 through a lateral passage 242. A similar projection 243 fits into a symmetrically positioned passage and the two projections 237 and 243 provide the drive connection to slide the flushing head into and out of the cavities. After the flushing head is used, it is returned to the tooling rack, where it is deposited for future use.

A similar flushing head is provided for the tooling, but since it is structurally similar to the flushing head 231 but differs therefrom principally in that it is provided with a smaller diameter to fit the tooling cavities, such flushing head has not been illustrated.

With the machine incorporating the present invention, full automatic tool changing is provided even though the machine involves a relatively large number of tools of different sizes and shapes. Further, the machine can be selectively operated to change only particular tools if an entire tool change is not required. This invention greatly reduces the time previously required for tool changes and eliminates virtually all of the labor involved in such tool changes. Since the tool changes can be accomplished relatively quickly and easily, a considerable increase in the production output of a given machine is realized.

Although the preferred embodiment of this invention has been shown and described, it should be understood that various modifications and rearrangements of the parts may be resorted to without departing from the scope of the invention as disclosed and claimed herein.

What is claimed is:

1. A forging machine comprising a frame, a slide reciprocable on said frame, tooling on said frame and slide operable in cooperation to form workpieces therebetween, tool storage means, replacement tooling in said tool storage for replacement of tools in said machine, and tool changing means operable to remove tools from said machine and to transfer said replacement tooling to said machine, said tool changing means including a tooling handling head and a transfer operable to selectively move said tooling handling head between said tool storage means and said machine, said machine and tooling handling head providing mating support surfaces which engage to precisely locate said head with respect to said machine and which absorb loads produced on said head during insertion and removal of tooling into and out of said machine, said tooling handling head including power drive means for inserting and removing tooling into and out of said machine.

2. A forging machine as set forth in claim 1, wherein said tooling includes tools having cylindrical mounting portions and said machine includes cylindrical cavities to receive associated tools with a close fit, said tooling handling head being operable to position said tools in axial alignment with the associated cavities and thereafter move said tools axially into said cavities.

3. A forging machine as set forth in claim 2, wherein said tooling handling head includes a support platform for supporting said tools in alignment with said associated cavities, and said power drive means sliding said tools along said associated cavities and said platform for inserting and removing said tools.

4. A forging machine as set forth in claim 3, wherein said power drive means and said tools include mating radially extending surfaces allowing said power drive means to move said tools axially in both directions.

5. A forging machine as set forth in claim 4, wherein said tooling includes separate tools having cylindrical mounting portions of at least two different diameters, and said support platform is movable between a first position to align associated cavities and tools of one diameter and a second position to align associated cavities and tools having another diameter.

6. A forging machine as set forth in claim 5, wherein said power drive means includes two pairs of said mating radial surfaces, with one pair operable with tools of said one diameter and the other pair operable with tools of said other diameter.

7. A forging machine as set forth in claim 6, wherein said mating support surfaces include surfaces on said frame and on said slide operable to support said tool handling head at both ends of said platform.

8. A forging machine as set forth in claim 1, wherein said mating support surfaces include surfaces on said frame and on said slide operable to support said tool handling head in a position between said slide and said frame.

9. A forging machine as set forth in claim 8, wherein first flushing means are provided to remove debris from said mating support surfaces.

10. A forging machine as set forth in claim 9, wherein said tooling is installed in cylindrical cavities in said machine, and cleaning means are provided to remove debris from said cavities.

11. A forging machine comprising a frame, a slide reciprocable on said frame, tooling on said frame and slide operable in cooperation to form workpieces therebetween, tool storage means adapted to receive replacement tooling and a tool changer operable to transfer tooling between said storage means and said machine, said tooling including tools having cylindrical bodies which are mounted within cylindrical cavities in said machine with a close fit, said tool changer including a tool handling head including a support platform operable to support said tools and movable to a position to support said tools in alignment with associated cavities, said tool handling head also providing a tool drive engageable with said tools operable to move said tools axially between said cavities and said platform.

12. A forging machine as set forth in claim 11, wherein said tool drive includes a tool engaging element providing opposed radially extending surfaces operable to engage mating surfaces on said tools for axially moving said tools in both directions.

13. A forging machine as set forth in claim 12, wherein power means are provided to partially eject at least some of said tooling from the associated cavities to expose the radially extending surfaces thereof.

14. A forging machine as set forth in claim 13, wherein said tooling includes separate tools, including cylindrical bodies of at least two different diameters, and said support platform is movable between a first position to align tools of one diameter with their associated cavities and a second position to align tools having another diameter with their associates cavities.

15. A forging machine as set forth in claim 11, wherein cleaning means are provided to clean debris from said cavities.

16. A forging machine as set forth in claim 15, wherein said tool changer is operable to transport said cleaning means between said storage means and cavities.

17. A forging machine as set forth in claim 16, wherein said cleaning means provides a liquid to flush debris from said cavities, and said tool changer provides conduit means to supply said liquid when said cleaning means is positioned thereby for cleaning cavities.

18. A forging machine as set forth in claim 11, wherein said machine provides power locking means for releasably locking said tooling on said frame and slide.

19. A forging machine as set forth in claim 18, wherein said locking means includes a wedge movable in a radial direction for engaging a mating wedging surface on an associated tool body.

20. A forging machine comprising a frame, a slide reciprocable on said frame, tooling on said frame and slide operable in cooperation to form workpieces, tool storage means, replacement tooling on said tool storage means, and a tool changer operable to transfer tooling between said storage means and said machine, said tooling including tools and dies each providing a cylindrical body, a cutter including a shear blade and a quill cooperating a shear workpieces from elongated stock, said machine providing a cylindrical cavity in which associated tools and dies are mounted with a close fit, said tool changer including a transfer and two tooling handling heads mounted thereon for movement between a first position in which one head is operable to handle said tools and dies and another position in which the other of said heads is operable to handle said cutter blade and quill.

21. A forging machine as set forth in claim 20, wherein said other head is provided with a pair of laterally movable projections operable to grip mating surfaces on said shear blade and said quill to grip them for installation and removal.

22. A forging machine as set forth in claim 21, wherein said projections are spring-biased to resiliently clamp said shear blade and quill against a surface on said other head.

23. A forging machine as set forth in claim 21, wherein said one head is provided with a support platform to support said tools and dies during tool changing, and a power drive for moving said tools and dies between said machine and said platform.

24. A forging machine as set forth in claim 23, wherein said machine includes powered clamping means for releasably clamping the individual tooling elements in said machine.

* * * * *